US005499891A

United States Patent [19]

Klenert

[11] Patent Number: 5,499,891

[45] Date of Patent: Mar. 19, 1996

[54] EARTH-RETAINING MODULE AND SYSTEM

[75] Inventor: Oskar H. Klenert, South Easton, Mass.

[73] Assignee: Earth Stabilizing Technology, Inc., Raynham, Mass.

[21] Appl. No.: 198,180

[22] Filed: Feb. 17, 1994

[51] Int. Cl.[6] ..... E02D 29/02

[52] U.S. Cl. ..... 405/284; 405/262; 405/286

[58] Field of Search ..... 405/16, 30, 31, 405/33, 262, 284, 285, 286, 287; 52/169.4, 604; 47/83

[56] References Cited

U.S. PATENT DOCUMENTS

| | | | |
|---|---|---|---|
| 2,902,743 | 9/1959 | King | 405/284 X |
| 4,964,761 | 10/1990 | Rossi | 405/284 X |
| 5,066,169 | 11/1991 | Gavin et al. | 405/284 |
| 5,108,231 | 4/1992 | Rausch | 405/284 |
| 5,154,542 | 10/1992 | Klenert | 405/286 |
| 5,214,898 | 6/1993 | Beretta | 405/284 X |
| 5,224,801 | 7/1993 | Quaney | 405/284 X |
| 5,252,017 | 10/1993 | Hodel | 405/284 X |
| 5,350,256 | 9/1994 | Hammer | 405/284 X |

FOREIGN PATENT DOCUMENTS

| | | | |
|---|---|---|---|
| 808990 | 11/1936 | France | 405/284 |
| 2436331 | 5/1980 | France | 405/284 |
| 178422 | 7/1990 | Japan | 405/284 |

*Primary Examiner*—John A. Ricci
*Attorney, Agent, or Firm*—Richard P. Crowley

[57] ABSTRACT

An earth-retaining concrete module and an interlocked earth-retaining terraced wall system employing such modules to stabilize earthen embankments and to reduce erosion from wave action. The module comprises an upright front wall and connecting side walls which form a U-shaped structure open at the top and adapted to receive fill material therein. The side walls of the module have at least one open notch in the top of each side wall, adapted to accept in an interlocked manner the width of the bottom of the front wall of a module in the next higher row in the wall system. The module includes a plurality of holes in the side walls to permit the side walls of adjoining modules to be secured together by pins or bolts. The side walls have inward-positioned wing side walls extending from the center of the side walls toward the rear of the side walls to place the center of gravity of the module toward the rear of the module. The module used in the bottom row of the wall system includes a foot section extending from the bottom of the front wall of the module to prevent scouring by wave action of the earth or sand against the front wall of the module.

27 Claims, 6 Drawing Sheets

EARTH-RETAINING MODULE AND SYSTEM

BACKGROUND OF THE INVENTION

It is desired to provide for earth stabilizing infrastructures which guard against erosion and earth movement, such as the stabilization of embankments, but more particularly to stop the erosion of sand and soil, from dunes or ocean beaches or other areas subject to wave action, which erosion is particularly caused by severe storm conditions or aggressive weather conditions or are related to the naturally occurring phenomenon of soil erosion and movement.

U.S. Pat. No. 5,154,542, issued Oct. 13, 1992, discloses an earth-retaining module and a wall system and method using such modules for stabilizing dunes and embankments. The patent discloses an earth-retaining concrete module adapted for use with other modules to form a wall system to stabilize earthen embankments, and to stop the erosion of sand dunes or soils along beaches subject to wave actions. The wall system provides for a plurality of side-by-side, secured together modules in defined, interlocked, stepped-back, upright rows to form an interlocked, secured, earth-retaining wall system. The modules employed in the wall system comprise an upright front wall and upright side walls connected therewith to form a generally U-shaped structure open at the top and bottom and adapted to receive fill material, such as earth, therein. The side walls of the modules have open notches, which notches are longitudinally aligned in the top of the side wall, with the notches of sufficient width to accept in an interlocked manner the width of the front wall of the module in a next higher row in the wall system. The modules also include a means to secure the side walls of the said modules together to an adjoining module to form a row of desired length, typically by employing holes in the sides of the modules and inserting in alignment pins or bolts to secure the side walls of said modules in place.

The module also includes a separate "dead man" slab element extending across the rear of the structure of the module, with the "dead man" slab element typically placed and mounted on two inward rear projections on the side walls of the module to support the "dead man" slab element in position. The earth-retaining module in the wall system composed of such modules, and the method of stabilizing earthen embankments as disclosed in the U.S. Pat. No. 5,154,542, provides an effective means to stabilize earthen embankments and to stop sand erosion along beaches and avoid many of the disadvantages of prior art techniques. However, it is desirable to provide for a new, improved earth-retaining module, system, and method which overcomes certain deficiencies and problems associated with the past module and system.

SUMMARY OF THE INVENTION

In the past, the earth retaining module and wall system provided for a precast, "U" shaped, reinforced, concrete module with a separately manufactured "dead man" slab, which was generally manufactured off-site and shipped to a site for installation. The present invention relates to an earth-retaining module and a wall system employing a plurality of such earth-retaining modules to provide stabilized infrastructures, such as earthen embankments, for use to stop erosion of dunes, or movement of sand or soil, along beaches.

The present invention is an improvement over the earth-retaining module system and method as described and set forth in U.S. Pat. No. 5,154,542, issued Oct. 13, 1992, which patent is hereby incorporated by reference in its entirety. The earth-retaining concrete module of the invention presents a significant improvement over the prior concrete module and is adapted for use of a module of the same kind or of the module set forth in U.S. Pat. No. 5,154,542.

The earth-retaining concrete module of the invention comprises an upright front wall having a top and a bottom and upright side walls, each having a top, a bottom, front and rear to form a module structure open at the top and preferably at the bottom and adapted to receive therein a fill material. The side walls each have at least one open notch in the top of each of the side walls, the notches being generally aligned and of a width to be adapted to accept in an interlocked manner the width of the bottom of the front wall of a module in a next higher row in the module wall system. If desired, there can be a plurality of aligned notches to provide for a variety of angles of the front at the slope of the wall system.

The each-retaining concrete module also includes a means to secure the side walls of the modules together to the side walls of an adjoining module in a wall system, and generally would include a plurality of holes in each of the side walls, with the holes adapted to receive alignment pins or bolts to secure the side-by-side modules together to form a multiple module wall system, such as at least two spaced-apart holes on each side wall. The holes in the side walls are also useful to provide for the movement of the modules into position by a small earth-moving machine, such as a backhoe, together with a lifting means, which includes a transverse bar and chain at each end which engage bolts or pins in the holes of the side walls. The improvement in the module, system and method comprises a "dead man" wing side wall means on and along each of the inside side walls of the module, and generally integrally formed therewith, and extending from about or slightly beyond the center of the side walls backward toward and to the rear of the side walls and of sufficient weight to place the center of gravity of the module toward the rear of the module.

Optionally but preferably, the wing side wall on one or both sides of the module may be provided with one or more holes positioned toward the rear of the wing wall and typically near the rear wall of the wing side wall to provide a means by which the modules, such as the end module units, may be anchored by rods or stakes into the ground or soil for additional stability.

Where the "dead man" wing side wall means are employed, the center of gravity is greater than about 24 inches from the face of the front wall of the module, and more typically placed at least forty percent of the distance from the face of the front wall of the module toward the rear wall of the module. The "dead man" wing side wall means may comprise integrally poured concrete formed at the time of manufacture of the precast concrete module, although the side walls may be separately secured to the interior of the side walls of the module. The modules of the invention may also be composed of a rigid plastic material, such as high impact plastic or resin-fiberglass, and made or molded hollow for easy transportation to the site where the hollow plastic module may be filled with sand, earth, gravel or a mixture thereof.

Generally, the wing side wall means comprise a polygonal structure which slopes downwardly from the rear of the side walls toward the front of and to the side walls. Typically, the structure is trapezoidal, with the short side of the trapezoid toward the front and the longer side aligned with the rear of the side walls. The wing side wall means comprise, in one embodiment, an upright rear wall along the rear of each of the side walls, a base which extends along the bottom of each of the side walls, and an upright front end wall which optionally extends past the center of the side walls of the module. In use, the height of the rear wall of the "dead man" wing side wall means is greater than the height of the front end wall, so as to shift the greater weight of the "dead man" wing side wall means toward the rear of the module.

It has been found that the use of wing side wall means to shift and to place the center of gravity rearward toward the rear of the module has many significant advantages over the employment of a separate, non-secured, slab-type element as a "dead man" weight extending across the rear of the module. The present invention provides for two "dead man" wing side wall means integrally located at the inside of the rearward extending side walls of the modules. The centroid of the module is shifted, for example, a distance of five inches or more to the rear of the module, and in addition, the soil bearing surface of the module is enlarged through the employment of the "dead man" wing side walls.

The employment of the "dead man" wing side wall means on each interior side of the module, in addition to shifting of the gravity to the rear and increasing the soil bearing surface of the module, promotes the safety of the module. The employment of prior art slab-type "dead man" may create a safety problem, as it is possible that during a storm of great intensity the "dead man" slab elements, merely resting on short rear projections, would loosen, move, and possibly become projectiles. When carried by wave action, these "dead man" projectiles could become dangerous as pieces of debris and as threats to the wall system. Where the modules employ a "dead man" wing side wall means, the interlocked, secured, earth-retaining module infrastructure making up the earth-retaining modular wall system cannot generally be dislodged by wave action, and therefore will not endanger in any way the safety of the upland beach property. Further, the employment of integrally formed or integrally secured "dead man" wing side wall means on each side of the side walls of the module avoids the need to ship separate "dead man" slab elements and to later reconcile a slab element with a particular module during wall installation. However, where applicable or required, the modules of the invention may also include the lateral "dead man" slab element to provide a greater shift in gravity, thus improving the ease and efficiency of manufacture, shipment and wall installation.

In another embodiment, an earth-retaining module having a lower foot section means is prepared and adapted for use with other modules. These footed modules are joined in side-by-side aligned fashion to form a securely attached row, which usually is then utilized as the bottom row of an interlocked, secured, earth-retaining modular wall system, to stabilize earthen embankments and to reduce erosion caused by wave action against the wall system. The module optionally and preferably may include a "dead man" means, and particularly a "dead man" wing side wall means as heretofore described. The lower foot section means extends outwardly away from the lower front wall on the bottom row modules in a system to form a plurality of aligned foot wall sections, which act to prevent wave action scouring at the toe of the front face of the module. The employment of an outwardly extending foot section means of the front wall of the module is necessary usually as an improvement on the bottom row of the earth-retaining modular wall system.

Typically, the foot means to prevent scouring of the toe at the bottom of the front wall of the module comprises an outwardly projecting, slightly downwardly sloping foot element integrally formed with or secured to the bottom front wall of the module. The foot means extends outwardly from the bottom substantially along the full length of the front wall of the module, so that when the module is employed with other like modules in a side-by-side relationship, the foot means extends throughout the entire length of the wall section, or that portion subject to scouring.

Generally, the foot means would extend outwardly to about 6 inches or more from the bottom of the front wall as desired and have an overall thickness at the outer end of at least about 4 inches or more as desired. The foot means, referred to as a "J" foot, prevents scouring at the toe of the bottom of the front wall section of the earth-retaining modular wall system.

It has been found that when water, particularly from ocean waves, strikes the surface of the earth-retaining modular wall system a swirling action occurs at the foot of the bottom wall. Such swirling action causes scouring, which scouring is directed downwardly and tends to remove soil or sand from beneath the bottom row of the wall system. The employment of the foot means or "J" foot, deflects the water in an upward direction to reduce scouring at the foot of the bottom row of modules, while in addition it increases the soil and load-bearing surface of the module.

The earth-retaining modules of the invention are utilized in an earth-retaining modular wall system to be generally installed with a sand dune, dike or shoreline embankment or other stabilizing infrastructure. Installation provides a secured, interlocking infrastructure wall system guarding against erosion and providing stabilization of an earthen embankment. The earth-retaining modules, covered with earth and/or sand, protect the sensitive environment of an earthen embankment or sand dune, while preserving their general aesthetic appearance. An earth-retaining modular wall system is particularly effective at preventing erosion of an earthen embankment by storm-wave action, where both a foot module means is employed on the bottom row of the wall system and "dead man" wing side wall means are employed on the insides of the side walls of the modules. Generally and preferably, the same type of earth-retaining modules of the invention, such as, for example, either solid or hollow-type modules, are employed at any one site.

The earth-retaining modules of the invention may be formed of precast concrete, and may be easily manufactured and cast in form-type molds to a size, weight and capacity so as to be handled by a small, for example, rubber tire backhoe or other vehicle used on beaches or in environmentally sensitive areas. In one embodiment as described, the poured concrete or plastic-filled modules generally range in weight from about 1800–2500 lbs., and have dimensions of a length of about 5 feet for each of the front wall and side walls; a height of about 2 feet, four inches for the front wall; a thickness of about 4–5 inches for the front and side walls; and "dead man" wing side wall means on each side which have a rear height of about 8 inches, a front height of about 4 inches, a width of about 6 inches, and a length along the base of the side wall of about 36 inches.

The use of such poured concrete "dead man" wing side wall means integrally placed within or securely attached to an earth-retaining module can move the center of gravity of the module to about 25 inches from the face of the front wall of the module, in comparison to about 20 inches where a "dead man" slab element is employed, as in U.S. Pat. No. 5,154,542.

In one embodiment, the earth-retaining modular wall system may employ a bottom row of the wall system having a "J" foot that extends outwardly from the front base of each module for a distance of about six inches, and having a height at the base end of the module of about four inches and a height at the front end of the module of about five inches. The entire "J" foot usually extends the length of the module, about 5 feet. The employment of a foot means or "J" foot along the bottom row of the earth-retaining wall system and extending outwardly therefrom, would tend to shift the center of gravity away from the rear of the module only slightly for that row. However, the employment of a "J" foot means as described would result in a shift in the center of gravity of about 1 inch toward the front face of the module, which shift is not of particular importance in the bottom row of the earth-retaining modular wall system. The interior space of the modules of the invention may be filled with a wide variety of fill-type :materials such as sand, soil, gravel and mixtures thereof. In another embodiment, the fill material may comprise crushed stone or gravel to provide an interior drainage area within the module and a system with one or more optional water-receiving pipes beneath the gravel or stone to receive and direct water away from a designated area.

In another embodiment, the module, where employed in a wall or protective system subject to the action of waves, may include either integrally formed or separately attached diversion panels. Typically, the panel extends the length of the front wall of the module and extends outwardly therefrom at or toward the top of the front wall of the module. The diversion panel may have the lower front wall angularly inclined slightly upward from the front wall of the module to divert incoming impact waves slightly upwardly and away from the protective infrastructure formed by the interlocked secured modules. The diversion panels may be used on all modules subject to wave impact, whether the frontal face of the modules is generally vertical or downwardly angled.

In a further embodiment, the module is typically, but not limited to, the footed type module which is used to form the one or more lower walls of a protective infrastructure system, may be provided with a slightly backwardly inclined front wall or panel such as up to about as high as 15 to 30 degrees or more and with side walls or panels at each end protruding outwardly from the front wall or panel. Generally, the side walls would extend generally vertically upwardly, while the front wall or panel would extend slightly backwardly at a selected straight angle from the foot or bottom of the module to the top of the front wall. The protruded side walls near the top of the module provide resistance to side impact waves in the wall system and also provides a means to collect wind drive sand. The use of the backward, inclined, protruding side wall modules also provides a break in the frontal face of the interlocked wall system, which provides aesthetic texture and shadow effects to camouflage and provide an aesthetic appearance to an otherwise non-sculptured, vertical wall system.

The inclined frontal wall or side-wall-protruded modules may also be employed with top diversion panels in the module, so that frontal impact waves striking the inclined frontal wall will be diverted upwardly by the inclined wall and then outwardly by the top diversion panel. The lower section of the incoming frontal impact waves, bearing sand, will be lifted upwardly and then away from the wall system, which further dissipates the energy of the wave and releases sand in front of the module. Also, wind driven sand and soil particles are trapped by the recesses below the diversion panel. It is recognized that a module may not have or require a foot or diversion panel and need not have side walls to protrude in the backward inclined front wall modules.

The modules are interlocked in a terracing manner to stabilize earthen embankments, reinforce earthen structures and to control erosion along waterways and beaches. The modules and the earth-retaining modular wall system may be used alone or with other stabilizing and control means, such as pilings and rip rap, as well as plantings.

The modules may be installed, for example, at the toe of an eroded dune or shoreline embankment to guard against further destruction or erosion, as a structural core within a levee or dike to prevent washout when supersaturated soil conditions occur, at the bottom of a cliff to manage surface water runoff and to prevent sloughing off of the bluff surface, in dikes and causeways to stabilize the structure and to provide a base for a roadway, and to stabilize and strengthen earthen dams.

The modules and earth-retaining modular wall systems may be covered with earth, or in applications where it is not desired to cover the earth-retaining modular wall system and leave the front wall face of the module exposed, it provides an area for landscaping and planting within the boxes formed by the terraced construction of the wall system.

The principal objective of the terraced wall system using the interlocked, aligned, terraced modules is to provide a means of stabilizing earthen embankments, levees, dikes, dams, sand dunes or sand shore embankments without undue disturbance of the existing sensitive environmental conditions. One method of construction of the wall system comprises: Preparing a level pad approximately eight feet wide and to the required length; cutting the pad into natural, existing, bearing soil or sand having a uniform moisture content (when installed in fill, the base course must consist of clean sand and/or gravel compacted to ninety-five percent maximum density); and setting modules of the first row by simply aligning them side by side so that the front panels form a continuous straight (or curved) surface. Alignment pins or bolts constructed of atmospheric corrosion-resistant material are used to hold the aligned modules together. This method includes: Back filling the bottom row with clean back fill or naturally occurring sand up to the bottom side of side wall cutouts (notches) and compacting the back fill; setting the next row of precast modules by fitting the center of the front panel into the notches of the first row, and bolting the modules together; and filling and compacting the modules of the second row with soil up to and level with the bottom of the wall notches. This procedure is repeated for all required successive rows, where sand dune stabilization is desired. The method includes covering the modules with sand to the required slope (4:1 recommended).

The module may be manufactured and constructed as a hollow-wall unit either integrally molded in one or several parts. The module may be constructed of a plastic or polymer material or fiberglass, such as, but not limited to, high impact resistant type plastic, with or without fiberglass or resin-impregnated fiberglass and assembled of precast, shaped or injected molded components. The hollow wall modules are easily shipped to an installation or project site, either as one unit or several separate units, which are assembled and secured, e.g. fused together, at the site into complete modules. The modules so finished or assembled are then employed as described to form an earth-retaining modular wall system. The hollow wall modules, after installation and alignment of each modular row of modules in the system, are filled with fill material, particularly sand, gravel, stone or a mixture thereof as specified for the particular project to obtain the desired weight required for structural stability of the module and for the desired degree of porosity for the drainage of water. The hollow wall module may be manufactured and used with the "dead man" wings, the "J" foot, or a combination thereof. The hollow wall module may be secured together by high tensile-strength plastic bolts.

Optionally and preferably, the hollow wall modules are formed with a plurality of weep or drainage holes in the bottom of the hollow wall section to permit the drainage of water. The hollow wall modules have open top walls, so that the modules may be filled easily on-site with fill material. The hollow wall modules with the weep or drainage holes are filled with a heavy, porous, particulate material like stone or gravel, which allows ground water seepage to enter the stone-filled module, which then acts as a French drain. Ground water seepage so intercepted from the module and system may be collected by a drainage pipe, such as a refracted under-drain piping system which discharges the collected water at a desired point of discharge.

The invention will be described for the purpose of illustration only in connection with certain illustrative embodiments. However, it is recognized that various modifications, changes, additions and improvements to the illustrated embodiments may be made by those persons skilled in the art without departing from the spirit and scope of the invention.

DESCRIPTION OF THE EMBODIMENTS

Figure 1:
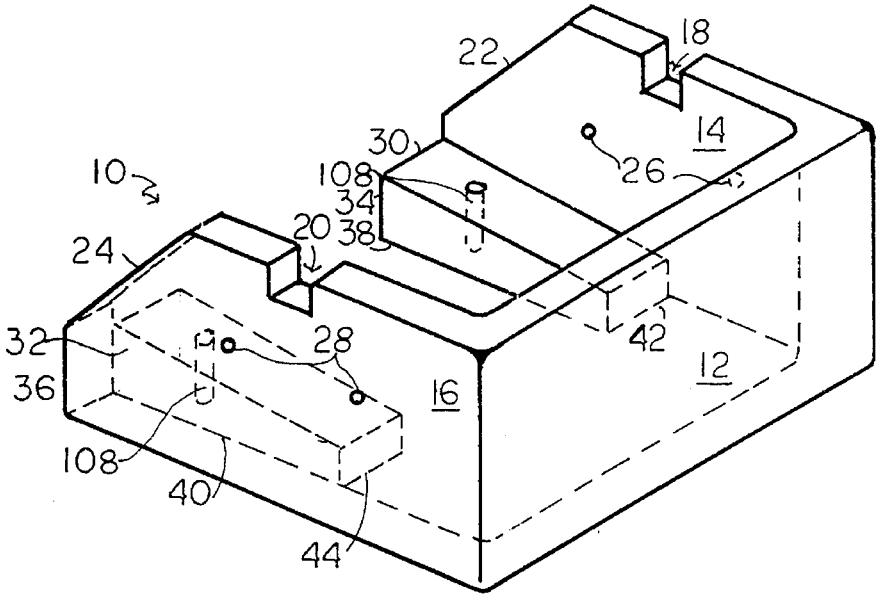
FIG. 1 is a perspective view from above of an earth-retaining module of the invention with an inner portion of the module illustrated in dotted lines.

FIG. 1 is a perspective view from above of an earth-retaining module 10 of the invention which comprises a vertically upright front wall 12, adjoining vertically upright side walls 14 and 16, the side walls 14 and 16 having substantially rectangular open notches 18 and 20 located at about a midpoint along the upper edge of the length of each side wall 14 and 16 and adapted to receive a width of the bottom of a front wall of a module in a next higher row in an earth-retaining module wall system.

The side walls 14 and 16 have free ends 22 and 24 that are sloped at about a 45 degree angle toward the rear of the module 10. A plurality of holes 26 and 28 at an intermediate level of the side walls 14 and 16 are adapted to receive bolts or alignment pins which serve as a means to secure the side walls 14 and 16 of one module to the side walls 14 and 16 of adjacent modules, and thereby to form an earth-retaining module wall system of any desired expanse.

FIG. 1 shows a precast concrete module 10 having an open top, bottom and back structures. This design is adapted to have these open structures filled with earth, soil, sand, gravel and any combinations thereof. Typically, the front and side wall lengths are about 5 feet and front and side wall heights are about 2–2.5 feet.

On each inside of the side walls 14 and 16 of the module 10, and integral therewith, are "dead man" wings 30 and 32 extending from about or slightly before the center of the sidewalls 14 and 16 backward toward the rear of the side walls 14 and 16 and having sufficient weight to place the center of gravity of the entire module 10 toward the rear of that module.

In FIG. 1, concrete "dead man" wings 30 and 32 are integrally cast with the module 10 at the time of manufacture. It is understood that other embodiments for the "dead man" wings 30 and 32 exist and may be utilized.

Figure 2:
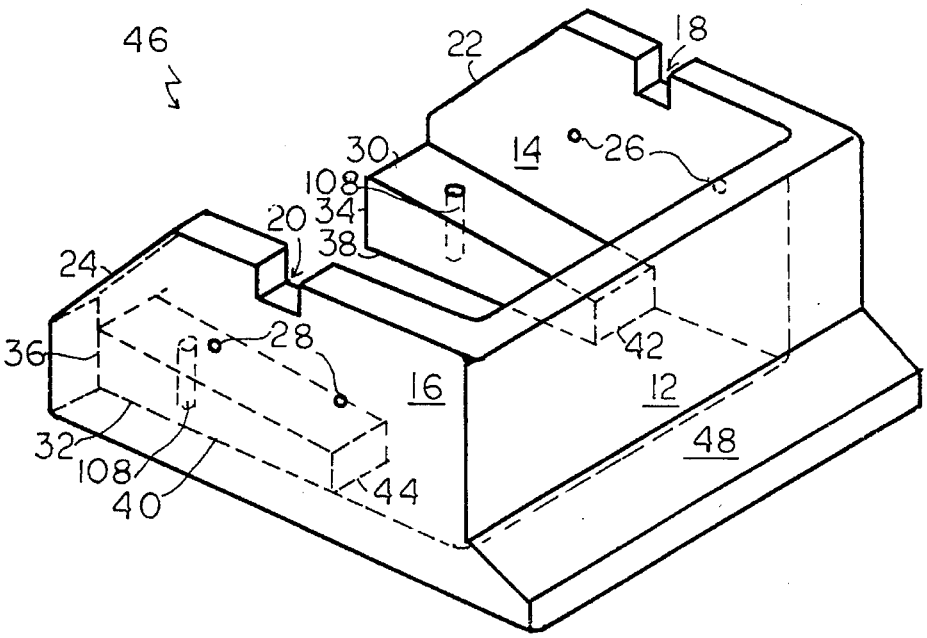
FIG. 2 is a perspective view from above of another embodiment of the earth-retaining module of the invention employed in the bottom row of a wall system with an inner portion of the module illustrated in dotted lines.

As seen in FIGS. 1 and 2, "dead man" wings 30 and 32 comprise a generally polygonal shape which slopes downward from the rear toward the front of the side walls 14 and 16. The "dead man" wings 30 and 32 typically include upright rear walls 34 and 36 along the rear of the side walls 14 and 16, bases 38 and 40 which extend along the bottom of each side wall 14 and 16 for an average length of about 36 inches, and vertically upright front end walls 42 and 44 that extend past the center of the side walls 14 and 16. The height of the rear walls 34 and 36 of the "dead man" wings 30 and 32 is generally about 8 inches and is greater than the height of the front end walls 42 and 44, which is generally about 4 inches. This difference in height between the front and rear walls of the "dead man" wings 30 and 32 serves to shift the weight of the "dead man" wings 30 and 32 toward the rear of the module 10 by a distance of about 5 inches, and adds to the soil-bearing surface area of the module 10 by the surface area of the bases 38 and 40 of the "dead man" wings 30 and 32. The increased base surface area for the entire module 10 plus the "dead man" wings 30 and 32 also promotes safety and stability of the module 10 when it is in place at a particular site.

FIG. 2 is a perspective from above of another embodiment of a concrete module 46. The module 46 retains the "dead man" wings 30 and 32 of module 10, and adds a lower foot section 48 extending outwardly from the bottom of the front wall 12 such that when module 46 is securely attached in side-by-side fashion to a plurality of like modules 46, each having a foot section 48, a row of aligned foot wall sections is formed. The outwardly-extending foot section 48 is referred to as a "J" foot.

In FIG. 2, a "J" foot 48 comprises an outwardly projecting, slightly downward sloping piece that is integrally formed or secured to the module 46. Typically, the "J" foot 48 extends outwardly from the front wall 12 for about 6 inches or more, has an overall outer thickness of about 4 inches or more, and lies substantially along the full length of the front wall 12 of the module 46. When a plurality of modules 46 are securely attached to one another, an entire length of bottom wall section of an earth-retaining modular wall system is protected from the swirling and scouring action of waves that would otherwise tend to remove sand and soil from beneath the bottom row of the wall system. Addition of a "J" foot 48 also increases the surface area of the bottom section of a module 46, thereby increasing the load-bearing surface of the module 46.

Figure 3:
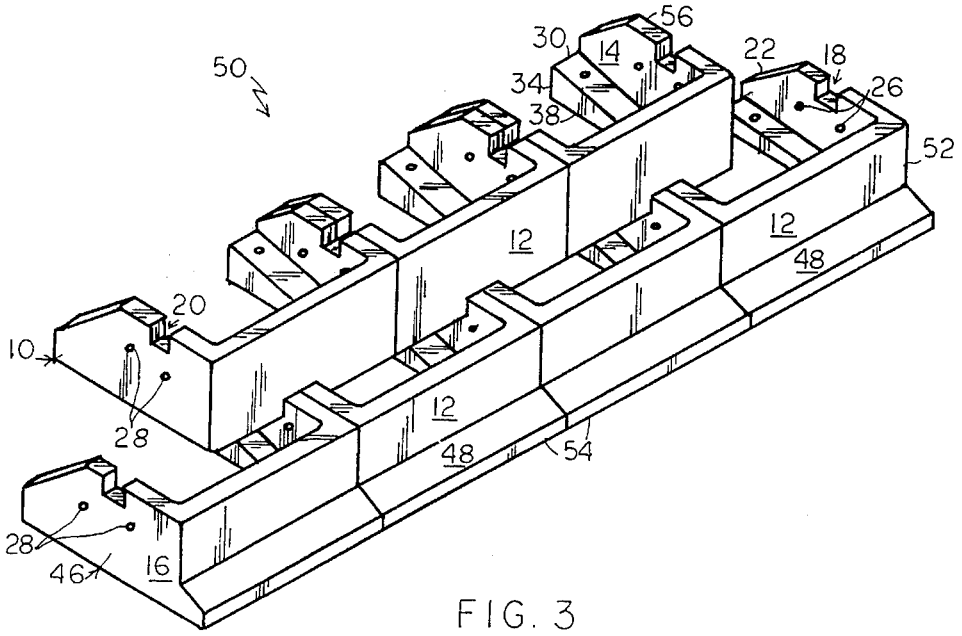
FIG. 3 is a schematic, perspective view from above of a secured, interlocked wall system of the invention employing the modules of FIG. 1 and FIG. 2.

FIG. 3 is a schematic, perspective view from above of a secured, adjoined and interlocked earth-retaining modular wall system 50 employing modules 10 and 46. FIG. 3 is shown without sand, soil, gravel, earth or any combination thereof within the modules 10 and 46. In the earth-retaining modular wall system 50, the bottom row 52 of modules 46 having a "J" foot 48 are securely attached to one another by means of pins or bolts through adjoining bolt holes 26 and 28 to form a continuous front surface 54 in a straight line. The second row of modules 10 are secured to one another in a manner similar to that of modules 46, and form the upper row 56. As illustrated and shown, the modules 10 are at each of their front walls 12 placed within the adjoining notches 18 and 20 of each module 46 of the base row 52 to secure the modules 10 in position. The modules are slidably positioned so that the modules 10 in the second row 56 are generally equally positioned on either side of the modules 46 on the lower row 52. FIG. 2 illustrates modules 10 and 46 with "dead man" wings 30 and 32 (obscured from view) without sand, gravel, earth, soil or any combination thereof for purposes of illustration and explanation only.

Figure 4:
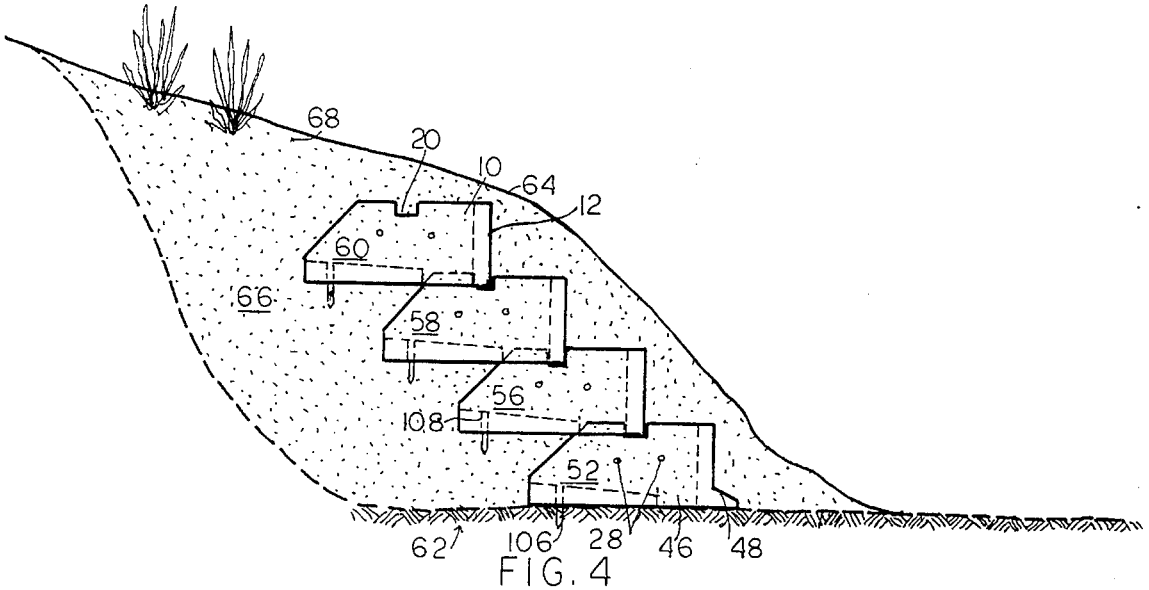
FIG. 4 is a schematic, illustrated, sectional view of the earth-retaining wall system of the invention, as shown in FIG. 3, in use.

FIG. 4 is a schematic, illustrated, sectional view of the earth-retaining modular wall system 50 of the invention shown in FIG. 3 placed within a beach embankment to prevent the erosion of sand from the beach area. A plurality of rows 52, 56, 58 and 60 of modules 10 and 46 are interlocked together by securing the side walls 14 and 16 of modules 10 and 46 by means of pins and bolts through bolt holes 26 and 28, and by placing the front walls 12 of the modules 10 in the open notches 18 and 20 of the next lower row of modules 52, 56 and 58. As illustrated, the modules are situated on a perma-wet sand base 62 and include a dumped beach sand covering 64, an existing sand dune 66, and a layer 68 of back filled, compacted 90% maximum density. The modules 10 and 46 in each layer 52, 56, 58 and 60 have been filled with beach sand and form an adjoined and interlocked infrastructure that stabilizes the sand dune while protecting the environment and providing a pleasing aesthetic appearance.

Figure 5:
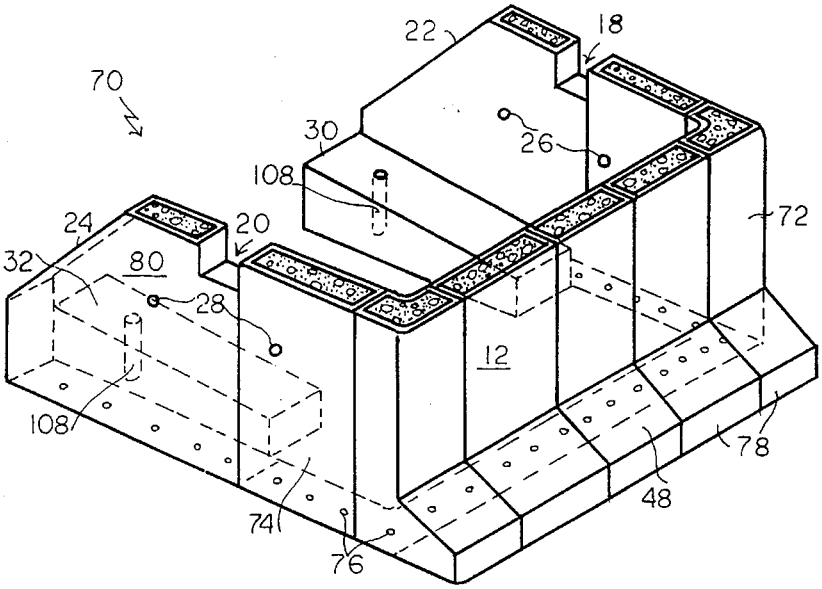
FIG. 5 is a perspective view of a hollow module embodiment of the invention with an inner portion of the module illustrated in dotted lines.

FIG. 5 is a perspective view of a hollow wall module 70. The module 70 is typically composed of a high impact plastic, though resin-impregnated fiberglass may also be used. The hollow wall modules 70 are constructed of precast, shaped or injected molded components, for example, 72 and 74, which are easily transported to an installation site as single units or small sections of the module 70. Assembly is accomplished by fusion or bolting together, typically by high tensile-strength plastic bolts, of the units such as 72 and 74 to form a completed module 70. The modules 70 are then employed as described earlier to form a module wall system 50.

The modular wall system 50, composed of modules 70, are filled with a fill-type material such as sand, gravel, stone, or a mixture thereof, following installation and alignment of the module wall rows such as 52 and 56 (see FIG. 3). Fill material is specifically chosen to meet the requirements of a particular project in order to obtain the desired weight for structural stability of the module and for the desired degrees of porosity for water drainage.

FIG. 5 shows a module 70 which includes a plurality of structural weep holes 76 in the bottom of the hollow wall sections 72 and 74 to permit water drainage. The hollow wall module 70 with weep or drainage holes 76 is typically filled with a heavy, porous, particulate fill material, such as stone and gravel, that allows water seepage through the particulate-filled module 70, and may optionally act like a "French drain" when one or more water-receiving pipes are placed beneath the weep-holes to collect and direct water away from a specific area.

The hollow wall module 70 may be manufactured with "dead man" wings 30 and 32, a "J" foot 48, or any combination thereof, depending on the requirements of a particular site.

Typically, a hollow wall module 70 has a front wall 12 comprising three generally rectangular, hollow wall units 74 securely attached to one another by fusion or high-tensile strength plastic bolts that extend through bolt holes 26 and 28, and two corner hollow wall units 72 joined to the generally rectangular, hollow wall units 74 also by high tensile-strength plastic bolts or by fusion to form a generally optimal length of about 5 feet and a height of 2 feet. The hollow wall module 70 has an attached "J" foot 48 extending out from the front wall 12 for about 6 inches and having a height of about 4 inches at its outermost, shortest face 78.

Side walls 14 and 16 comprise a generally rectangular unit 74, a portion of corner unit 72, and a polygonal unit 80 joined in the manner described for the front wall 12. The polygonal unit 80 includes notches 18 and 20, rear-sloping walls 22 and 24, and has attached, and preferably integrally molded, "dead man" wings 30 and 32 at its inner sides.

Figure 6:
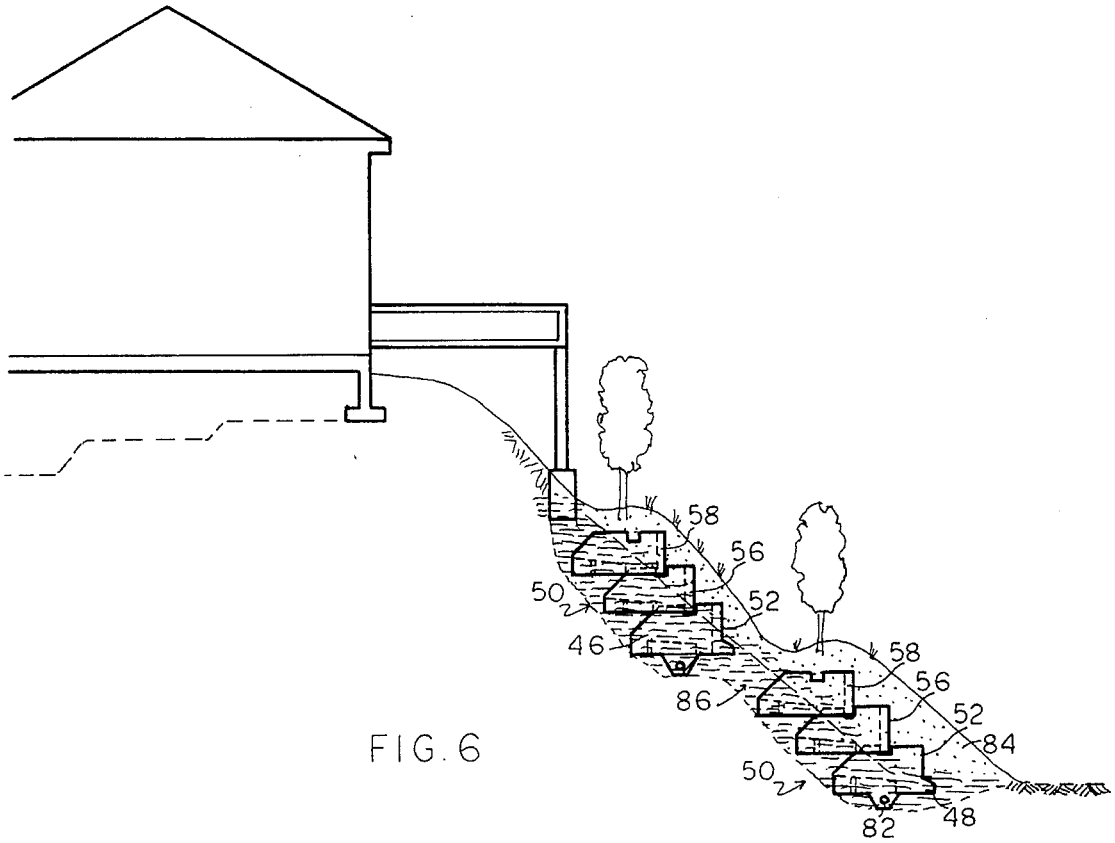
FIG. 6 is an schematic, illustrative sectional view of an earth-retaining modular wall system employing modules of FIG. 1 and FIG. 2 in place at a site.

FIG. 6 shows a representative module wall system for embankment stabilization. As in FIG. 4, rows of adjoined modules 46, each having "J" foot 48 components, comprise the bottom rows 52 of each module wall system 50. Rows 56 and 58 of the earth-retaining module wall system 50 may comprise either solid modules 10, such as composed of concrete, or hollow wall modules 70 manufactured from high impact plastic. When hollow wall modules 70 are employed, weep holes at the bottom of the modules 70 may drain water into a common under-drain pipe 82 that receives and directs water away from a designated area. Both machine-placed fill 84 and structural, machine-compacted back fill 86 aid the placement and retention of the earth-retaining module wall system 50 in its selected site. The earth-retaining module wall system 50 forms an embedded infrastructure covered by soil and low-growing trees and bushes that provides simultaneous stabilization for the embankment and aesthetic appeal.

Figure 7:
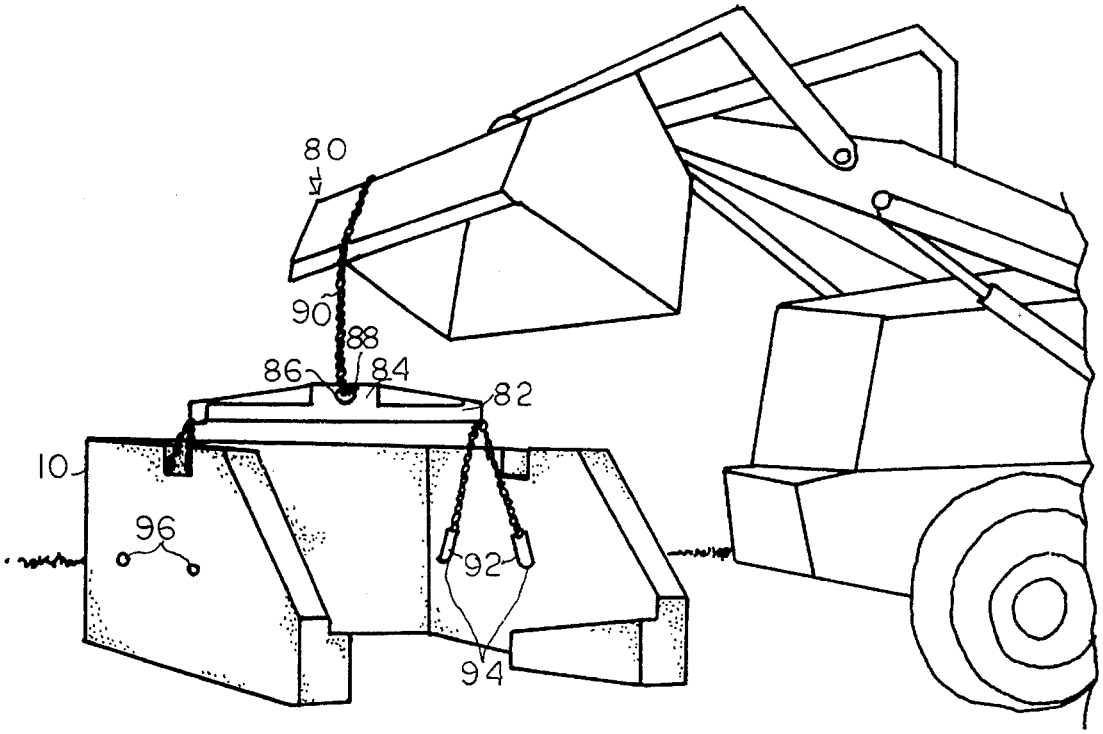
FIG. 7 is a perspective, illustrative view of the module of FIG. 1 secured for movement to a site.

FIG. 7 shows a precast concrete module 10 of FIG. 1 being moved and lifted by the use of a backhoe 80 to a site. The module lift system includes a transverse steel beam 82, generally extending about the length of the module and including a central raised support 84 with a hole 86 therein for the insertion of a hook 88 attached to a lift chain 90 on the outwardly extending beam of the backhoe 80. The beam 82 has two downwardly extending chains 92 at each end with flat plates 94 secured to the free end and having bolts or pins 96 which are inserted in the module holes 26 and 28, with the chains 92 at each end generally aligned with the inside wall of the module 10 during the lifting and movement to the placement site.

Figure 8:
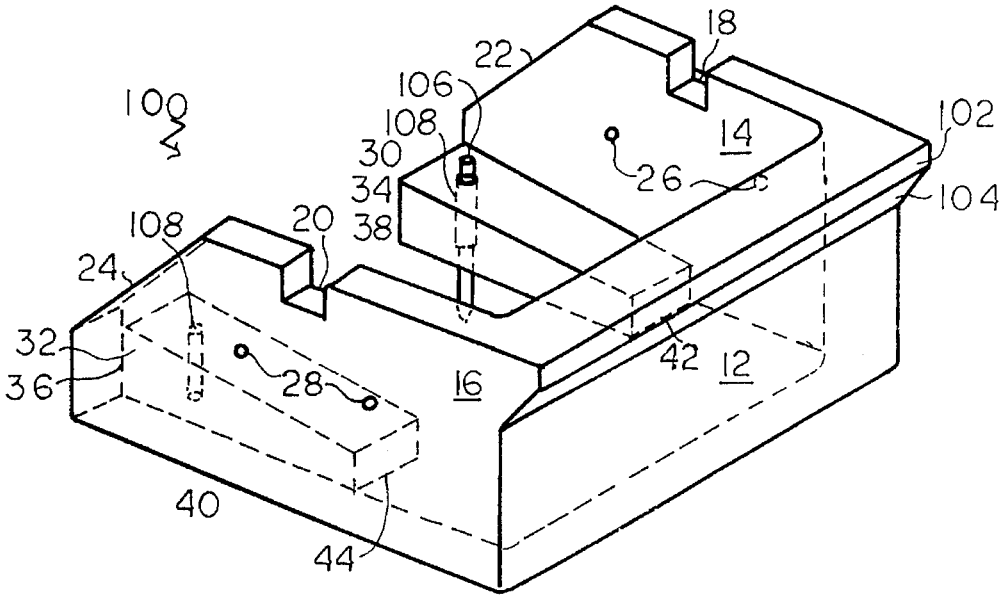
FIG. 8 is a perspective, illustrative view from above of another module of the invention with an inner portion of the module illustrated in dotted lines.

FIG. 8 shows a module 100 of the invention, which module includes an outwardly extending polygonal diversion panel 102 which is formed at the top of the vertical front wall 12 of the module 10 and includes a straight, upwardly angled lower wall 104 to divert waves impacting the front wall of the module outwardly and away from the infrastructure wall system.

Figure 9:
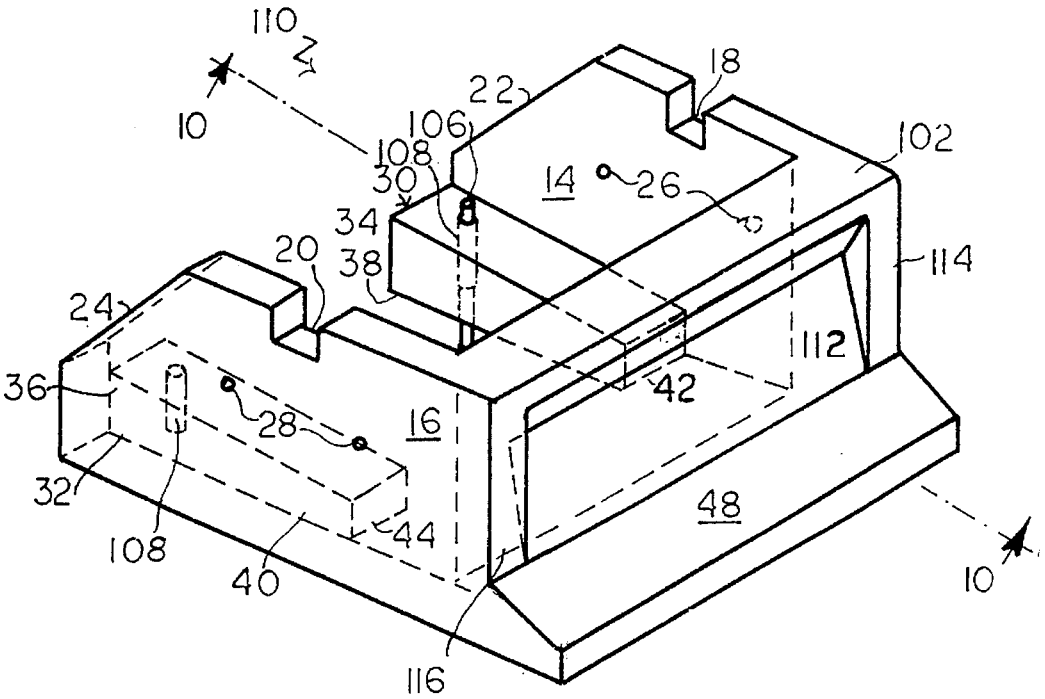
FIG. 9 is a perspective, illustrative view from above of a further module of the invention designed for use as the lower bottom wall of a protective system with an inner portion of the module illustrated in dotted lines.
Figure 10:
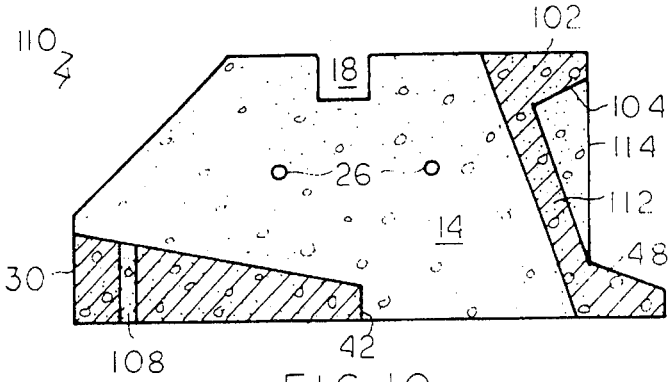
FIG. 10 is a sectional view along the line 10—10 of the module of FIG. 9.

FIGS. 9 and 10 are directed to an enclosed front, angled side-wall-protruding module 110 for the purposes of illustration containing an outwardly-extended foot section 48 with the module 110 designed to be a part of or form a bottom or lower wall section of an infrastructure formed of the modules 10. The module 110 includes the top angled, extended diversion panel 102 of FIG. 8, but also is characterized by a backward inclined frontal wall or panel 112 of the module 110 and a pair of end side walls 114 and 116 with front edges which are generally vertical and thus form a means in the module 110 between the side walls 114 and 116, the inclined front wall 112, and the bottom foot section 48 to divert waves impacting the front wall of the module outwardly and away from the infrastructure wall system.

Figure 11:
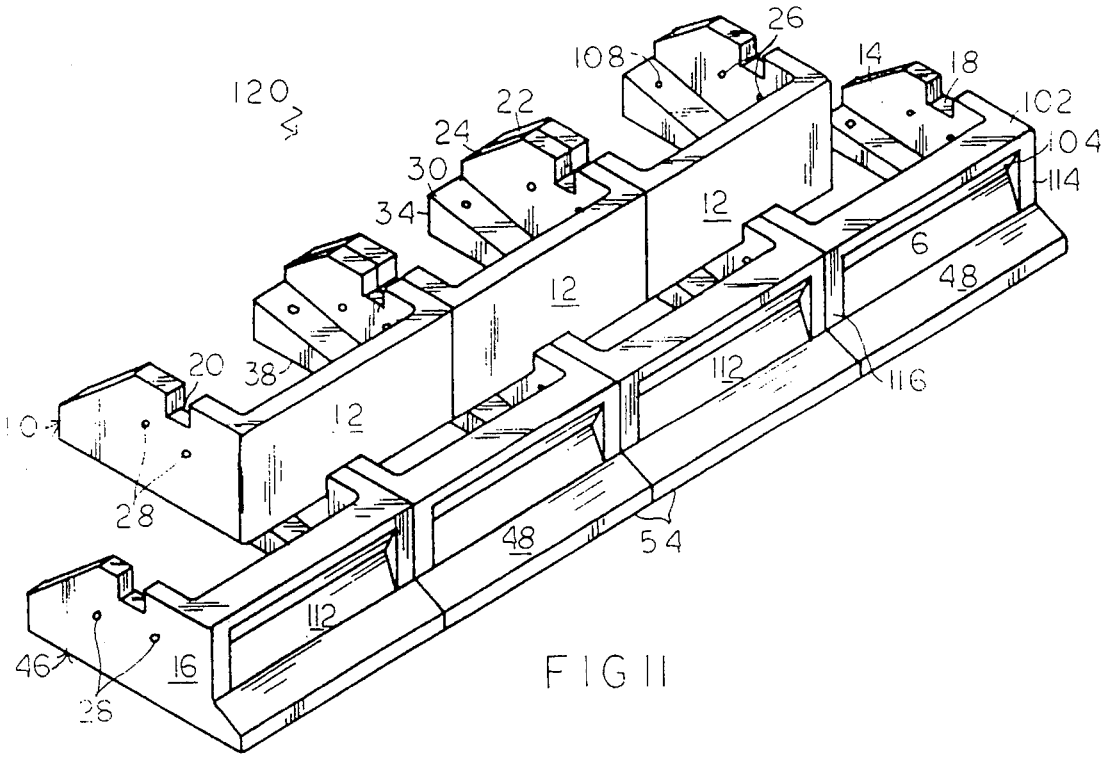
FIG. 11 is a perspective, illustrative view of a wall system employing the modules of FIG. 1 and FIG. 9.

FIG. 11 illustrates an infrastructure protective wall system 120 formed by the use of the modules 10 and 110 of the invention and particularly useful if the wall system is subject to wave action.

The module also includes a pair of soil anchor holes in each wing 40 and 42 so that soil anchor stakes 106 can be inserted through the holes 108 and into the soil to stabilize further the module in the wall system.

It is recognized that the various modules disclosed may be used alone or in combination, or where applicable, with the prior art "dead man" modules to form a whole variety of protective, interlocked, stepped arrangement infrastructures.

What is claimed is:

1. In an earth-retaining module adapted for use with other modules to form an interlocked, earth-retaining wall system to stabilize embankments and to reduce erosion, which module comprises:

a) an upright front wall having a top and a bottom, and upright side walls, each having a top, a bottom, front and rear to form a structure open at the top and adapted to receive fill material therein;

b) each of the side walls having at least one open notch on the top of the side walls, the notches generally aligned and of a width to accept in an interlocked manner, the width of the bottom of the front .wall of a module in the next higher row in a wall system; the improvement which comprises a "dead man" wing side wall means, which comprises a structure which slopes downwardly from the rear of the side walls toward the front of the side walls and positioned on the inside of each of the side walls of the module and extending from about the center of the side walls toward the rear of the side walls and of sufficient weight to place the center of gravity of the module toward the rear of the module.

2. The module of claim 1 wherein the center of gravity is greater than about 24 inches from the face of the front wall of the module.

3. The module of claim 1 wherein the center of gravity is placed at least 40 percent of the distance from the face of the front wall of the module to the rear of the side walls.

4. The module of claim 1 wherein the wing side wall means are integrally formed with the module.

5. The module of claim 1 wherein the wing side wall means comprises a polygonal structure which slopes downwardly from the rear of the side walls toward the front of the side walls.

6. The module of claim 1 wherein the wing side wall means comprises a polygonal structure having an upright, long, rear wall along the rear of the side wall, a base which extends along the bottom of the side wall and an upright, short, front end wall which extends beyond the center of the side wall.

7. The module of claim 6 wherein the polygonal structure is a trapezoid with the height of the rear end wall greater than the height of the front end wall.

8. The module of claim 7 wherein the rear wall has a height of about 8 inches, the front end wall a height of about 4 inches, and the structure has a width of about 6 inches.

9. The module of claim 1 wherein the module includes a foot section means extending outwardly from the bottom of the front wall and along the length thereof to prevent scouring of the bottom of the front wall when the module is employed in the bottom row of a wall system.

10. The module of claim 9 wherein the front wall of the module is inclined backwardly to divert waves to move upwardly on the front wall.

11. The module of claim 10 which includes a panel diverter means extending across the top of the front wall of the module to divert waves outwardly from the modules.

12. The module of claim 11 which includes a pair of end side walls of the modules which protrude outwardly from the inclined front wall at each end thereof.

13. A protective wall system which comprises a plurality of interlocked stepped back, earth-retaining, open modules, the modules filled with earth and which wall system includes a bottom row of inclined modules of claim 12.

14. The module of claim 1 wherein the module comprises a hollow, lightweight module adapted to receive fill-type material within the front and side walls of the module.

15. The module of claim 14 which includes a foot section means which comprises a foot element which extends outwardly up to about 8 inches from the bottom of the front wall and has a thickness of at least about 4 inches or less at the outer end.

16. The module of claim 14 wherein the "dead man" means comprises a wing side wall means on either side wall and extends downwardly from the rear of each side wall.

17. The module of claim 1 wherein the module comprises a reinforced precast concrete module.

18. The module of claim 1 wherein the module includes a pair of aligned, open notches one on each of the side walls and each notch positioned about intermediate the rear of the side walls and the front wall.

19. The module of claim 1 which includes means to secure the side walls of said module to the side walls of an adjoining module, which means includes a pair of spaced-apart holes in each of the side walls of the module.

20. The module of claim 1 which includes an open bottom and an open rear.

21. A wall system including an earthen embankment, which wall system comprises a plurality of the modules of claim 1 arranged in a side-by-side, secured position and arranged in a plurality of interlocked, upright, terraced, extending rows and the modules containing a fill material.

22. The wall system of claim 21 which includes as the bottom wall of the wall system a plurality of aligned, secured modules of claim 9.

23. A wall system to reduce the erosion of sand or earth from wave action, which wall system comprises a plurality of earth-retaining modules arranged in a side-by-side, secured, aligned position, and arranged in a plurality of interlocked, upright, extending, terraced rows, the modules containing a fill material to form an embankment, and which wall system employs a plurality of the secured aligned modules of claim 22 as at least a part of the bottom row of the wall system.

24. The module of claim 1 which includes at least one soil anchor hole in the side wing walls to permit anchoring of the module into the soil.

25. The module of claim 1 which includes a panel diverter means extending across the top of the front wall of the module to divert waves outwardly from the modules.

26. The module of claim 25 wherein the panel diverter means extends generally the length of the front exterior wall of the module and an upwardly inclined bottom wall surface.

27. An earth-retaining module adapted for use with other modules to form an interlocked earth-retaining wall system to reduce erosion at the bottom of the wall system, which module comprises:

a) an upright front wall having a top and a bottom and upright side walls each having a top, a bottom, front and rear to form a structure open at the top and rear and adapted to receive fill material therein;

b) each of the side walls having at least one open notch in the top of the side walls, the notches generally designed and of a width to accept in an interlocked manner the width of the bottom of the front wall of a module in the next higher row in a wall system;

c) means to secure the side walls of the said module to the side walls of an adjoining module in a wall system;

d) a "dead man" wing side wall means which comprises a polygonal structure which slopes downwardly from the rear of the side walls toward the front of the side walls to provide weight to the rear section of the module and shift the center of gravity to the rear of the module; and e) a foot section means to prevent scouring of the bottom of the front wall of the module, which foot section comprises an outwardly projecting, downwardly sloping foot element from the bottom of the front wall and extending substantially along the length of the front wall of the module.

* * * * *